US006298626B2

(12) United States Patent
Rudden

(10) Patent No.: US 6,298,626 B2
(45) **Date of Patent: *Oct. 9, 2001**

(54) INTERLOCKING INSULATED SIDING AND METHOD

(76) Inventor: Edward P. Rudden, 13129 Isle Of Mann, Highland, MD (US) 20777

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,409

(22) Filed: May 6, 1999

(51) Int. Cl.[7] ..... E04D 1/00

(52) U.S. Cl. ..... 52/520; 52/539; 52/546; 52/586.1; 52/592.1; 52/754.1; 52/795.1; 52/309.9

(58) Field of Search ..... 52/309.9, 539, 52/519, 520, 525, 551, 546, 547, 288.1, 586.1, 592.1, 794.1, 795.1, 406.1

(56) References Cited

U.S. PATENT DOCUMENTS

| | | | | |
|---|---|---|---|---|
| 2,009,056 | * | 7/1935 | Schaffert . | |
| 2,292,984 | * | 8/1942 | Alvarez, Jr. . | |
| 2,398,632 | * | 4/1946 | Frost et al. | 52/539 X |
| 2,400,357 | * | 5/1946 | Krajci | 52/539 |
| 2,961,804 | | 11/1960 | Beckman . | |
| 3,248,835 | * | 5/1966 | Westland | 52/539 X |
| 3,605,369 | | 9/1971 | Merrill et al. . | |
| 3,913,292 | * | 10/1975 | Braekkan | 52/406.1 |
| 4,304,080 | * | 12/1981 | Freeman | 52/309.9 |
| 4,545,162 | * | 10/1985 | Attaway | 52/288.1 X |
| 4,571,909 | | 2/1986 | Berghuis et al. . | |
| 4,586,304 | | 5/1986 | Flamand . | |
| 4,774,794 | | 10/1988 | Grieb . | |
| 4,969,302 | | 11/1990 | Coggan et al. . | |
| 5,090,174 | | 2/1992 | Fragale . | |
| 5,425,210 | * | 6/1995 | Zafir | 52/309.9 X |
| 5,465,543 | | 11/1995 | Seifert . | |
| 5,501,050 | * | 3/1996 | Ruel | 52/520 X |
| 5,625,999 | * | 5/1997 | Buzza et al. | 52/309.9 X |
| 5,636,489 | | 6/1997 | Leverrier et al. . | |
| 5,664,376 | * | 9/1997 | Wilson et al. | 52/288.1 X |
| 5,715,637 | | 2/1998 | Hesterman et al. . | |
| 5,974,748 | * | 11/1999 | Sciuga et al. | 52/309.9 X |
| 6,009,679 | * | 1/2000 | Larsen | 52/539 X |
| 6,050,041 | * | 4/2000 | Mowery et al. | 52/520 |
| 6,122,877 | * | 9/2000 | Hendrickson et al. | 52/520 |

* cited by examiner

*Primary Examiner*—Beth A. Stephan
*Assistant Examiner*—Brian E. Glessner
(74) *Attorney, Agent, or Firm*—Nixon & Vanderhye P.C.

(57) ABSTRACT

A siding panel is formed of a one-piece enclosure delimiting an insulation chamber. An insulating material is disposed in the insulation chamber. The one-piece enclosure defines a male engagement section and a female engagement section, which are engageable with respective engagement sections of adjacent siding panels. In a siding panel system, the panels are thus interlockingly engaged in a stacked relationship. In forming the one-piece enclosure, a suitable plastic material or the like can be formed using a mandrel or other suitable forming tool, or the enclosure can be formed by extrusion or molding to form a seamless enclosure. The insulating material is blown in through a hole formed in an interior surface of the siding panel or through the sides and is selected to obtain a desired R-value for the siding panels.

17 Claims, 9 Drawing Sheets

INSIDE CORNER

INTERLOCKING INSULATED SIDING AND METHOD

BACKGROUND OF THE INVENTION

The present invention relates to interlocking insulated siding and, more particularly, to insulated siding for exterior construction formed with a one-piece enclosure delimiting an insulation chamber housing an insulating material.

Various types of siding panels are commonly used for exterior wall coverings in construction. Siding panels are typically less expensive than brick in material costs as well as labor costs.

An important characteristic of an exterior wall covering is to seal out elements while preventing inside conditioned air from being affected by ambient air, i.e., providing insulation. Conventional insulated siding, however, typically requires a layered installation of materials, which results in increased installation costs and time. Moreover, because the insulating material is not completely enclosed by the material of the siding panel, the insulation may be exposed to outside elements, detrimentally affecting the ability of the insulation to function efficiently.

Still further, existing siding does not have a sufficient R-value or insulation and is typically merely a shell that does not fit securely to properly protect the structure. Without a secure fit, wind can get behind the siding creating interior drafts, and insects such as bees, wasps, silverfish, spiders, etc. can readily penetrate into the structure. Moreover, existing products are susceptible to being removed or torn off by high winds.

There is yet another product that applies insulation (which is shaped similarly to siding) to the structure exterior as an underlayer to conventional siding, which acts as a protective shell. This product, however, uses a multi-step process and is difficult to install, thereby increasing costs. Furthermore, although this product provides some insulation, it still suffers from the same deficiencies as aluminum and vinyl siding. That is, because the siding fits loosely to the exterior of the structure, it allows for aggressive weather and insects to penetrate the siding and enter the structure.

Over time, wood siding products (both redwood and cedar) warp and crack allowing insects and wall-damaging moisture to invade the structure.

SUMMARY OF THE INVENTION

It is therefore an object of the invention to provide a siding panel, a siding panel system and a method of manufacturing a siding panel that overcome the drawbacks associated with conventional arrangements. It is another object of the invention to provide a siding panel that is inexpensive to manufacture and simple and inexpensive to install.

With the interlocking, insulated siding product of the invention, the consumer receives a tight, waterproof exterior. The product insulates against temperature losses while also preventing interior drafts and insect infestation. The insulated siding according to the invention also provides sound insulation and is maintenance free.

These and other objects of the invention are achieved by providing a siding panel including a one-piece enclosure delimiting an insulation chamber, and an insulating material disposed in the insulation chamber. The one-piece enclosure defines a male engagement section and a female engagement section that are shaped for interlocking engagement with adjacent panels.

In accordance with another aspect of the invention, there is provided a siding panel system attachable to a surface and including a plurality of siding panels each including the one-piece continuous enclosure delimiting the insulation chamber and the insulating material disposed in the insulating chamber. The siding panels in accordance with this aspect of the invention are interlockingly engaged in a stacked relationship. The siding panel system may include a corner kit having a bent angle frame and inserts for accommodating bends in the surface. Additionally, the siding panel system may include a transition piece for transitioning between the siding panels according to the invention and conventional frame molding.

In accordance with yet another aspect of the invention, there is provided a method of manufacturing a siding panel including the steps of forming a one-piece enclosure delimiting an insulation chamber, and inserting an insulating material in the insulation chamber.

With this construction, the outer skin of a house or other structure can be made waterproof and provide a maintenance-free protective coating. The R-value of the siding can be controlled by varying the insulating material within the insulation chamber. The insulating material preferably also includes fire retardants. The enclosure is preferably made of fiberglass, vinyl, PVC or similar plastic material. The interlocking structure of the panel system is designed to prevent moisture, drafts, insects, etc. from entering the structure. Additionally, each siding panel may be silicon caulked to create a seamless outside barrier. With the preferred materials, the siding can be manufactured in virtually any color or can be made with designer touches to simulate wood or other building materials or a beaded effect.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
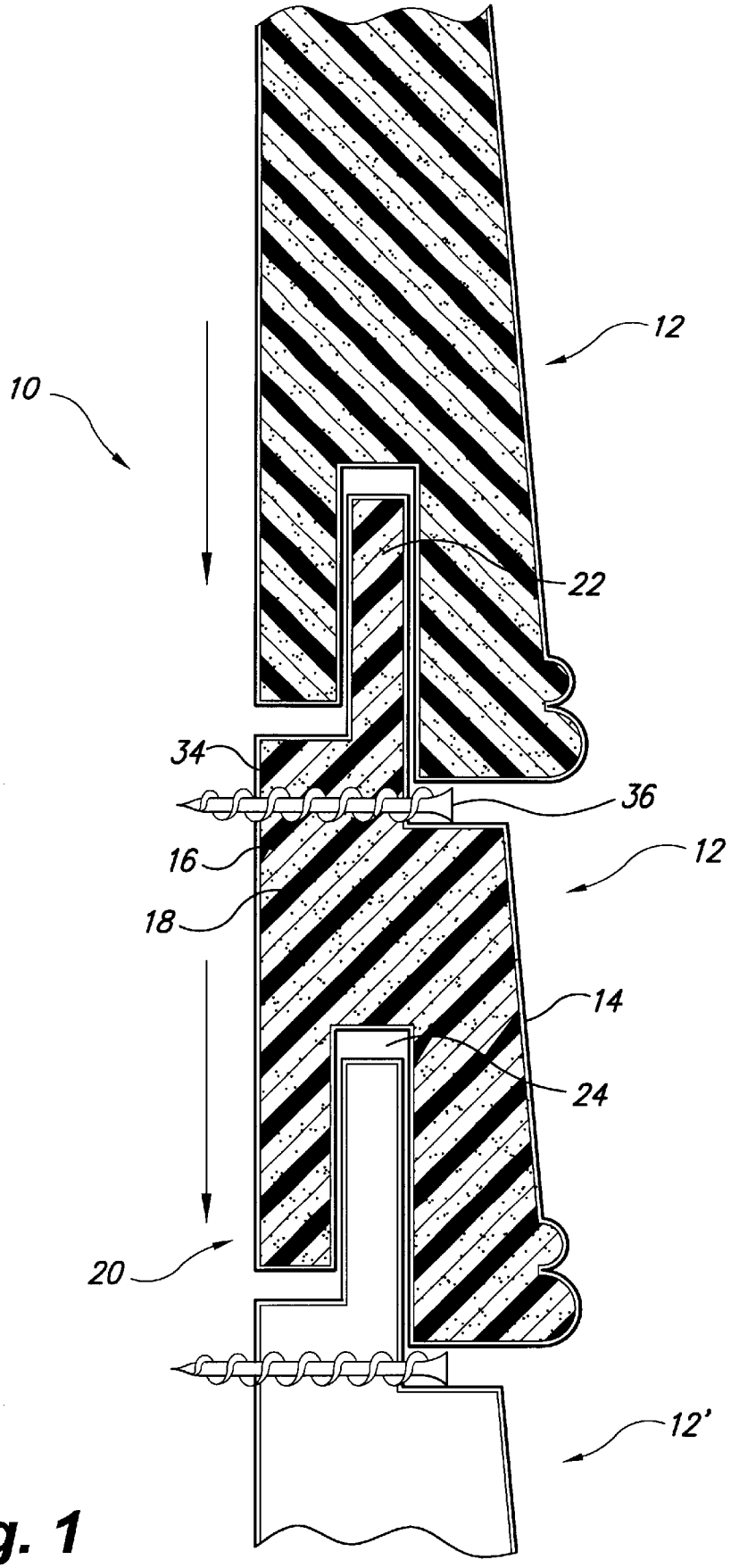
FIG. 1 is a side view of a panel system including the siding panel according to the present invention.

FIG. 1 is a side view of a preferred siding panel system according to the present invention. The siding panel system 10 includes a plurality of siding panels 12 in an interlocking relationship. In preferred forms, the siding panels 12 interlock one another in a stacked relationship as shown.

Each panel 12 is formed of a one-piece preferably plastic enclosure 14 delimiting an insulation chamber 16. In the context of the present invention, the term "plastic" refers to any material that is capable of being shaped or formed. In preferred embodiments, the enclosure 14 is formed of fiberglass, PVC or vinyl. Other suitable materials include aluminum, steel, ABS or the like.

An insulating material 18 is disposed in the insulation chamber 16. The insulating material 18 is preferably formed of a fire resistant foam insulation or like material, the selection of which serving to control the R-value of the siding panels. The insulating material may alternatively or additionally contain fire retardants. In manufacturing the siding panel 12, after forming the one-piece enclosure, the insulating material 18 can be blown in by a suitable apparatus through an aperture formed in an interior side 20 of the enclosure 14, e.g., by drilling. Alternatively, the insulation can be blown in from the side of the siding panel 12, injected by a suitable injection process, poured with the siding placed vertically using the siding itself as a container, or the like. In an alternative arrangement, the insulating material is air (as shown in FIG. 1 with respect to siding Panel 12').

With conventional vinyl or aluminum siding, the hollow siding shell can be easily deflected, leading to a more flimsy product. With the insulating material 18 disposed in the siding insulation chamber 16 according to the invention, the siding is made rigid, creating a more robust product that is easier to handle and install.

Figure 3:
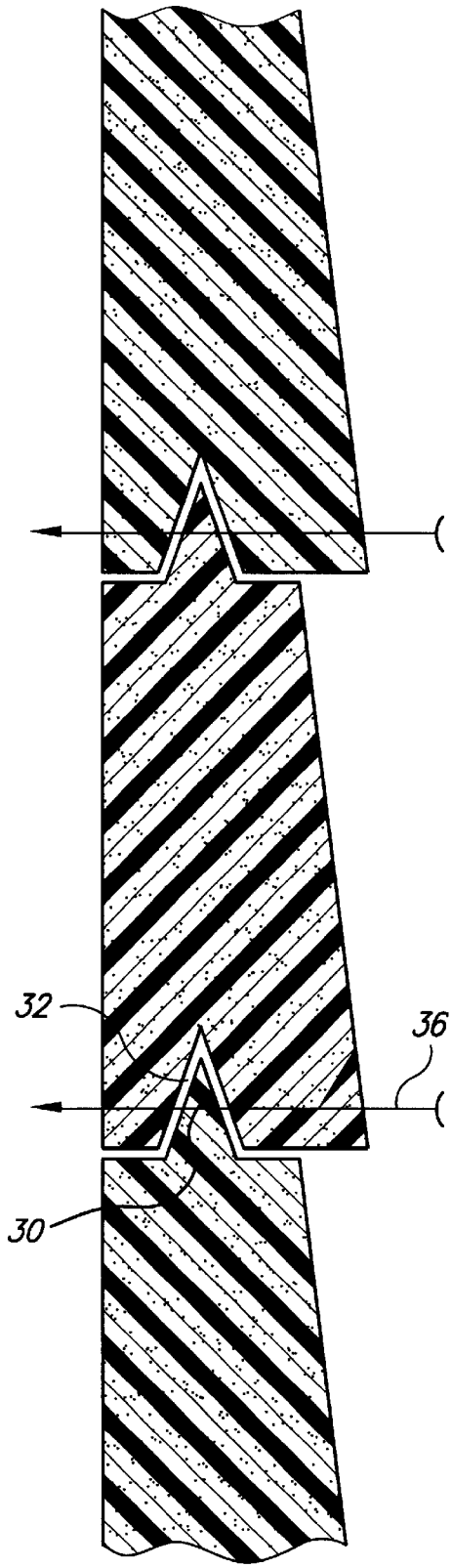
FIG. 3 is a side view of another alternative siding panel according to the present invention.
Figure 4:
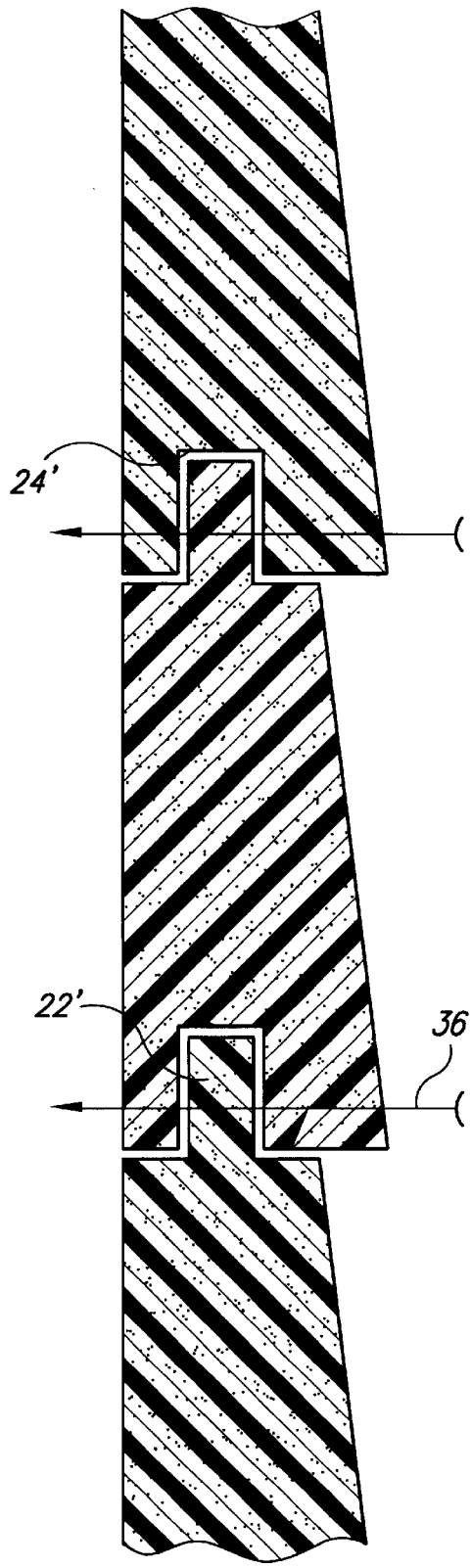
FIG. 4 is yet another alternative embodiment of the siding panel according to the present invention.

The enclosure 14 defines a male engagement section 22 and a female engagement section 24 shaped to receive respective female and male engagement sections of adjacent siding panels. FIGS. 1 and 4 illustrate one preferred arrangement of the engagement sections including a tab 22, 22' and slot 24 disposed respectively at opposite ends of the panel. In another alternative arrangement, with reference to FIG. 2, the panel includes an extension member 26 and a shoulder 28 shaped to receive the extension member 26 disposed respectively at opposite ends of the panel. In still another arrangement, with reference to FIG. 3, the structure for interlockingly engaging adjacent panels includes a tapering protrusion 30 and an inverse tapering indentation 32 shaped corresponding to the tapering protrusion 30. The tapering protrusion 30 and the inverse tapering protrusion 32 are disposed respectively at opposite ends of the panel.

Figure 2:
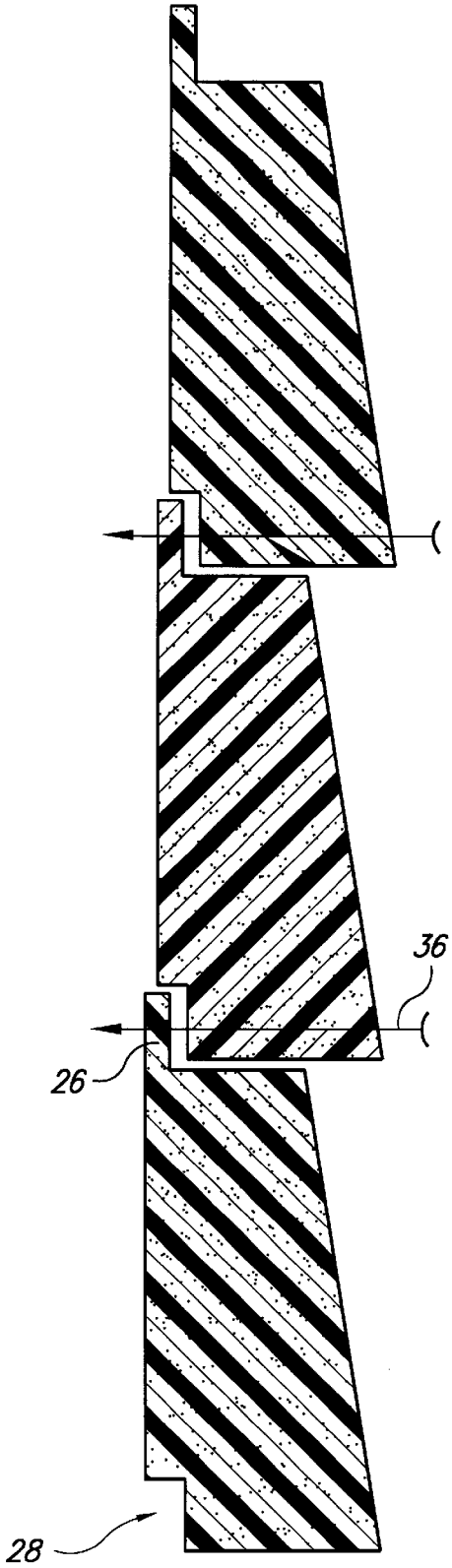
FIG. 2 is a side view of an alternative embodiment siding panel.

The panel also includes at an intermediate section thereof an attachment member section 34 that receives a suitable attachment member 36 such as a screw or nail or the like for securing the panels 12 to an exterior wall or other structure. The attachment member 36 may extend only through a single siding panel as shown in FIG. 1 or may extend through adjoining interlocked siding panels as shown in FIGS. 2–4.

In one form of the invention, the one-piece enclosure 14 is formed by first taking a sheet of the plastic material and rendering it into a pliable state, such as by heat and/or pressure or other suitable means. Once in a pliable state, the sheet can be formed into a desired shape for example by the use of a mandrel or other forming tools. The connected seam completing the enclosure can then be welded in a known manner. As an alternative, depending on the material, the enclosure can be formed by an extrusion process. By extruding the material, the enclosure 14 can be seamless. In yet another alternative method of construction, the enclosure 14 can be molded. Of course, those of ordinary skill in the art may contemplate alternative methods of manufacture of the structure according to the invention, which methods are intended to be encompassed by the present disclosure, and the invention is not meant to be limited to the described examples.

Figure 5:
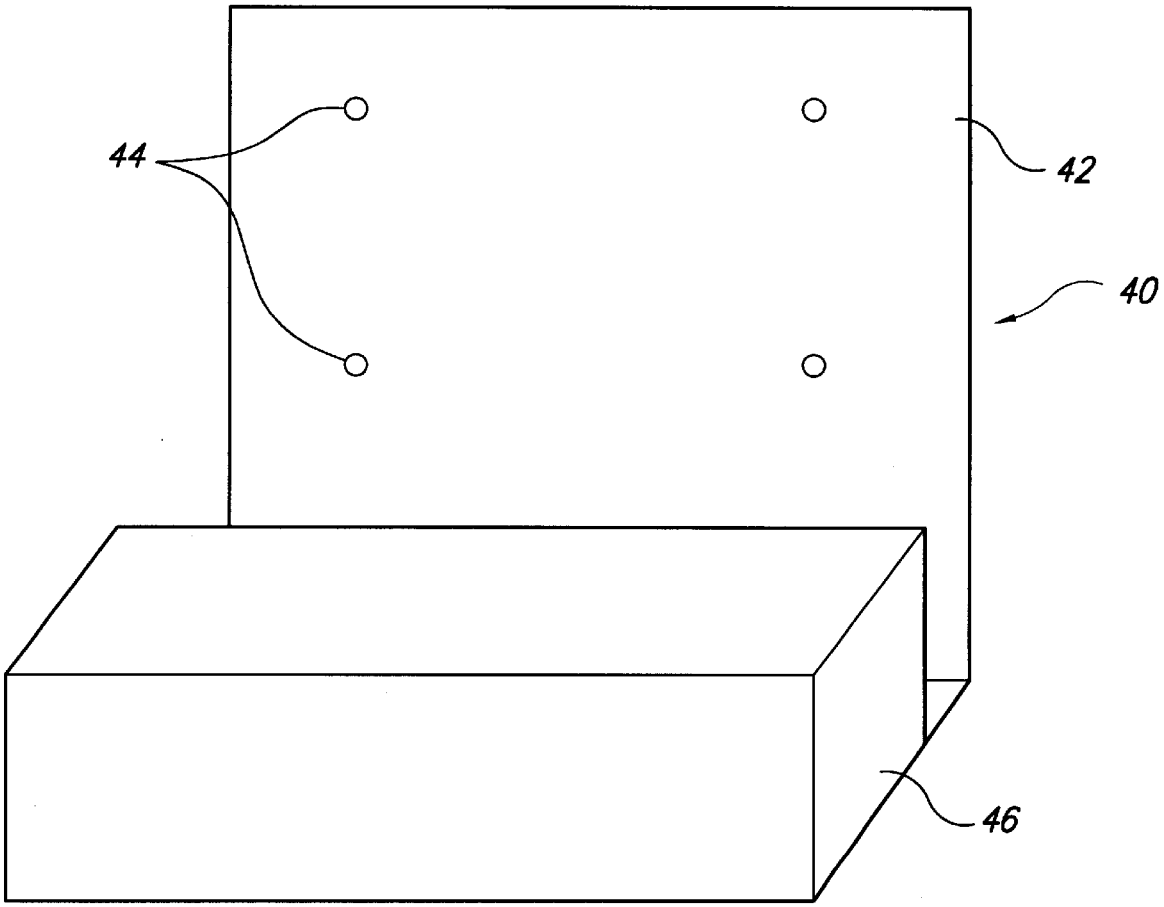
FIG. 5 illustrates a bottom bracket for anchoring a first piece of siding according to the invention.

FIG. 5 illustrates a bottom bracket 40 that is used to anchor and support the first piece of siding at the base of an exterior wall. The bracket 40 includes an attachment plate 42 that is secured to the exterior of the structure with appropriate screws or the like via screw holes 44, for example. A male engagement member 46, although shown generically in FIG. 5, is preferably shaped according to a corresponding female engagement section at a bottom side of the siding panel. The bottom bracket 40 is preferably formed of metal such as aluminum.

Figure 6:
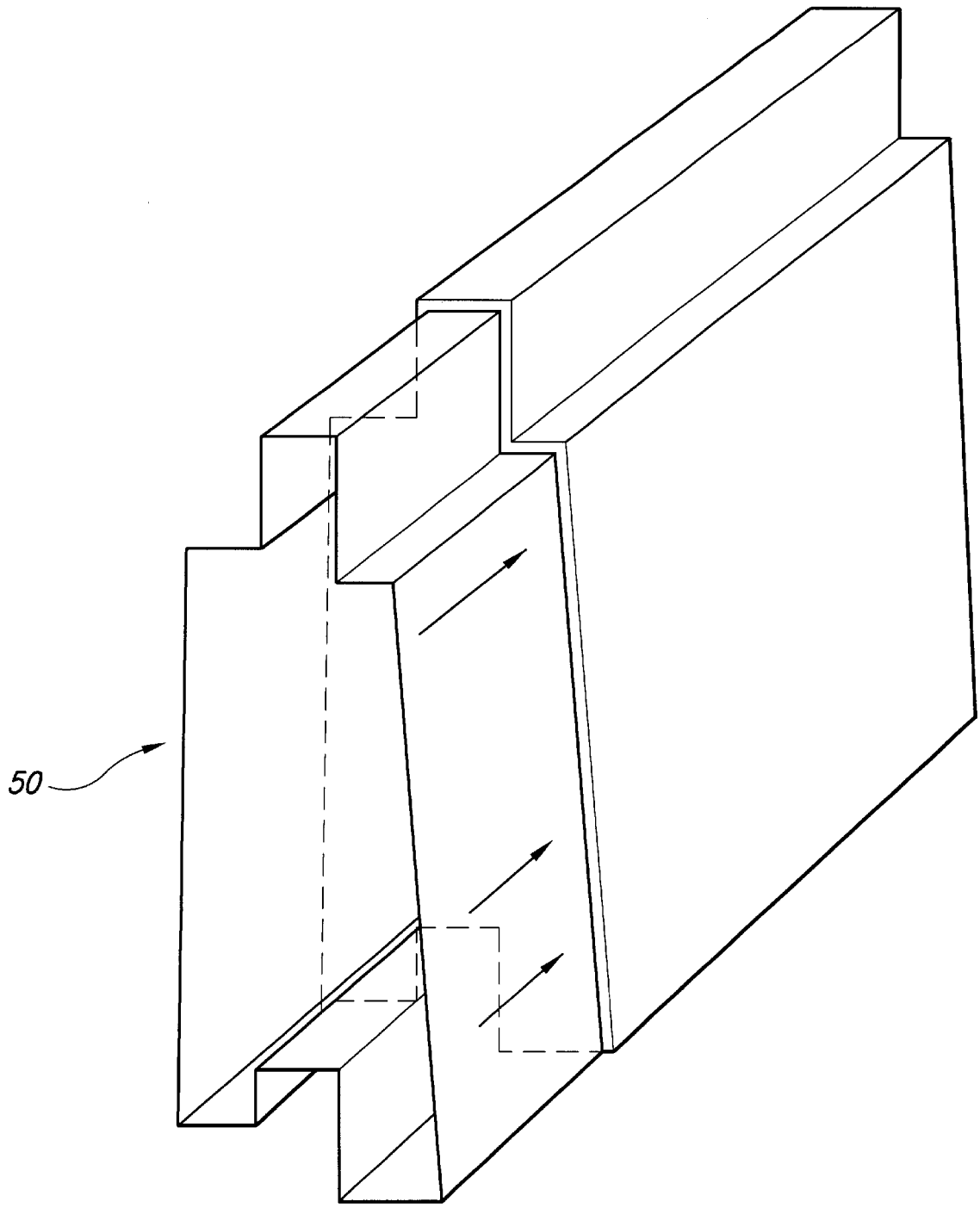
FIG. 6 illustrates a channel connector for the siding according to the invention.

FIG. 6 is a perspective view of a channel connector 50 that serves to fit adjacent siding panels together (in the same plane) and to ensure that moisture does not get behind the siding. The channel connector 50 is preferably a hollow metal piece, such as aluminum, formed of a similar cross section to the siding panel but slightly smaller. The connector fits into a small space formed in abutting ends of the siding panels. The space at the end of the panels can be created during insertion of the insulating material 18 into the insulation chamber 16 or may be created by removing a portion of the insulation at the end of the siding. Once the channel connector 50 is inserted halfway into the side of a siding panel in a friction fit, a second piece of siding can be attached to the channel connector 50 in the same manner. The channel connector 50 thus ensures a tight insulated fit between two pieces of adjacent siding.

Figure 7A:
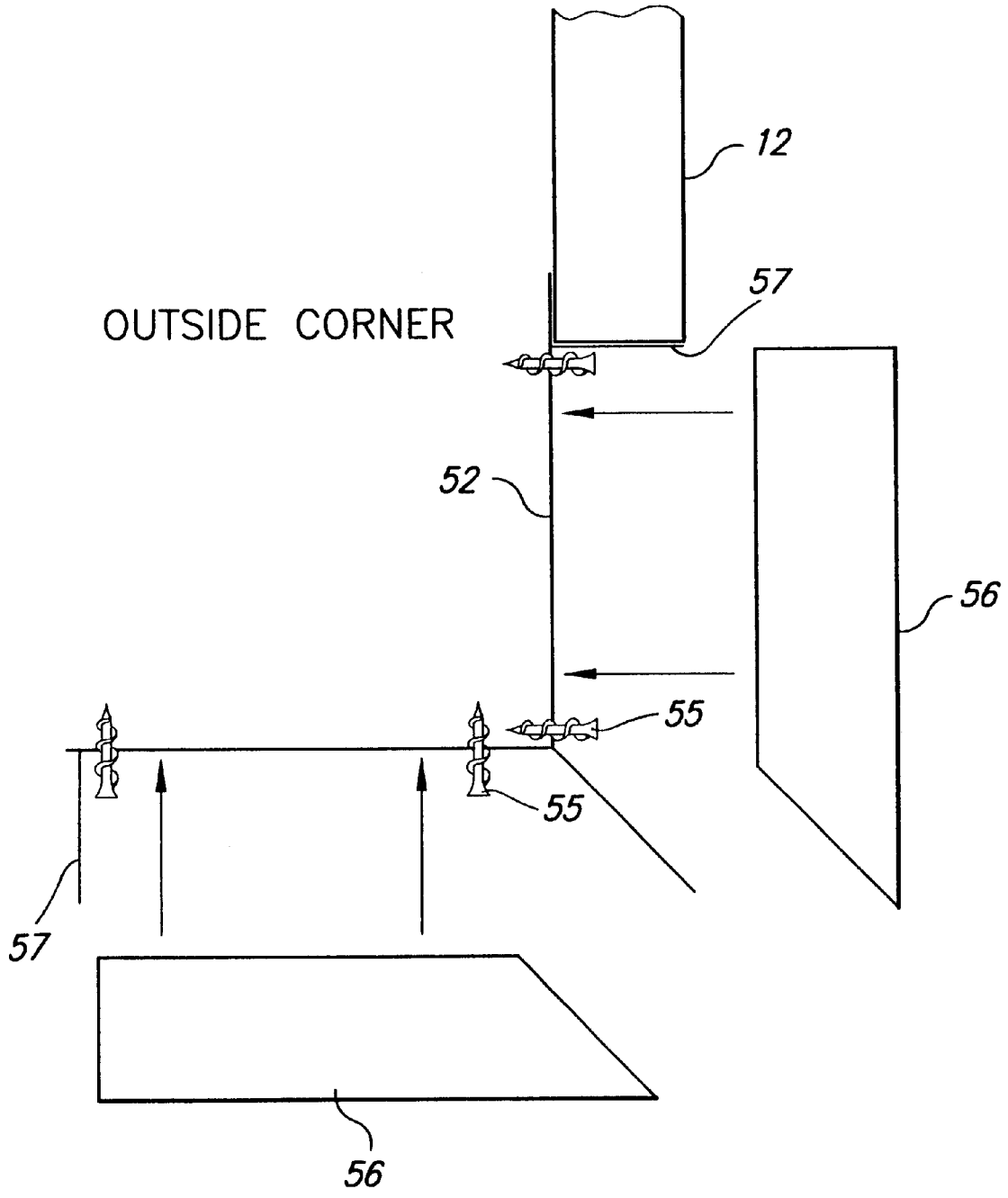
FIGS. 7A and 7B illustrate angle frames for house corners.
Figure 7B:
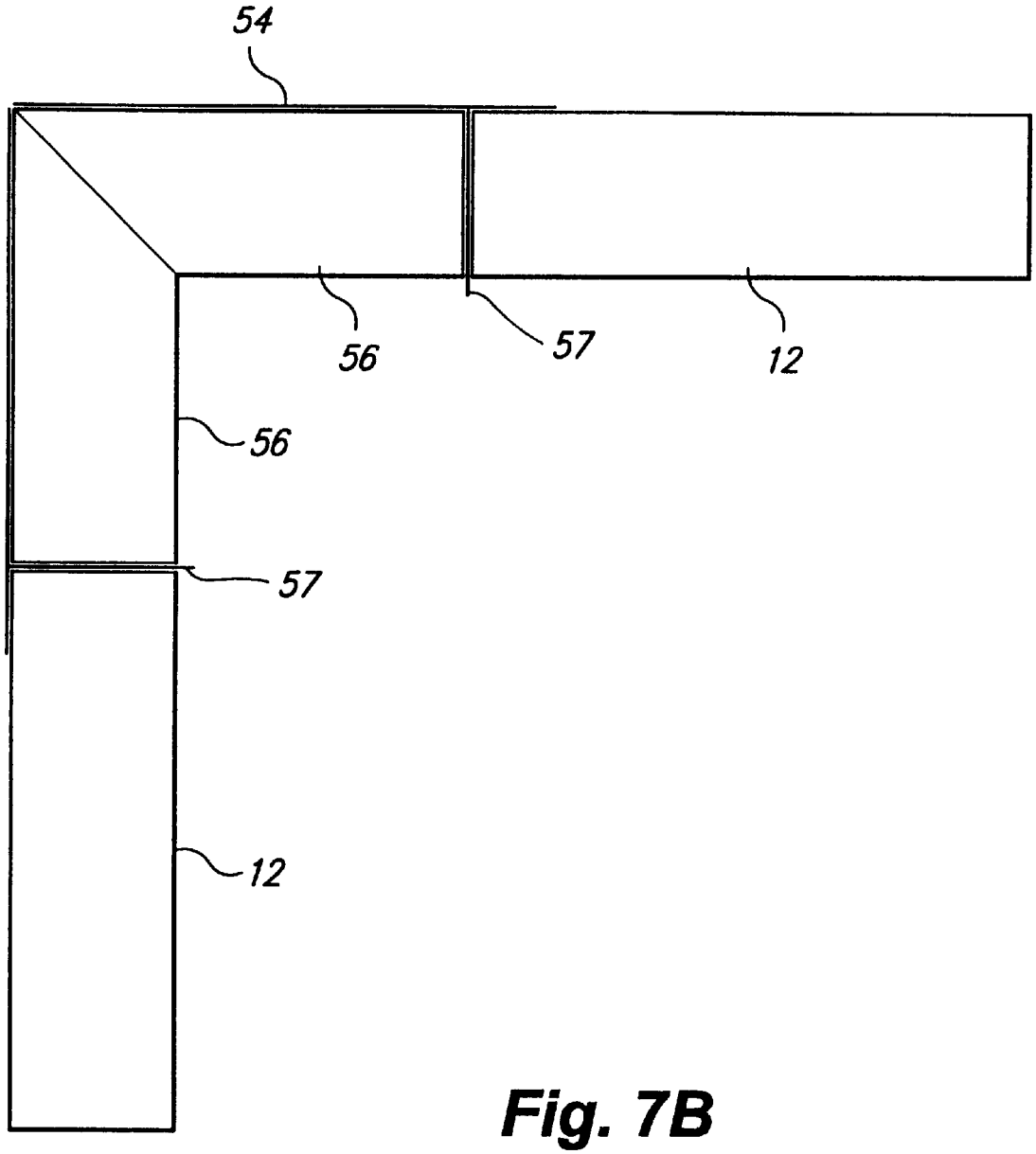

Exterior acute and obtuse angles, such as house corners and the like, can be accommodated using a corner kit including an angle frame formed of plastic or like material. FIGS. 7A and 7B illustrate angle frames 52, 54 for accommodating outside and inside corners of the structure, respectively. The angle frames 52, 54 are secured to the structure with screws 55 or the like, and inserts 56 of a construction similar to the siding panels are adhered preferably by gluing to the angle frames and are custom fit to cover the outside or inside corner of the structure. With the siding panels 12 running horizontally across the exterior of the structure, the angle inserts 56 are preferably secured to the angle frames 52, 54 in a vertical orientation to minimize the number of pieces and facilitate installation. The angle frames 52, 54 include a connecting piece 57 at outside or distal ends thereof as shown in FIGS. 7A and 7B for attaching the siding panels 12.

Figure 8:
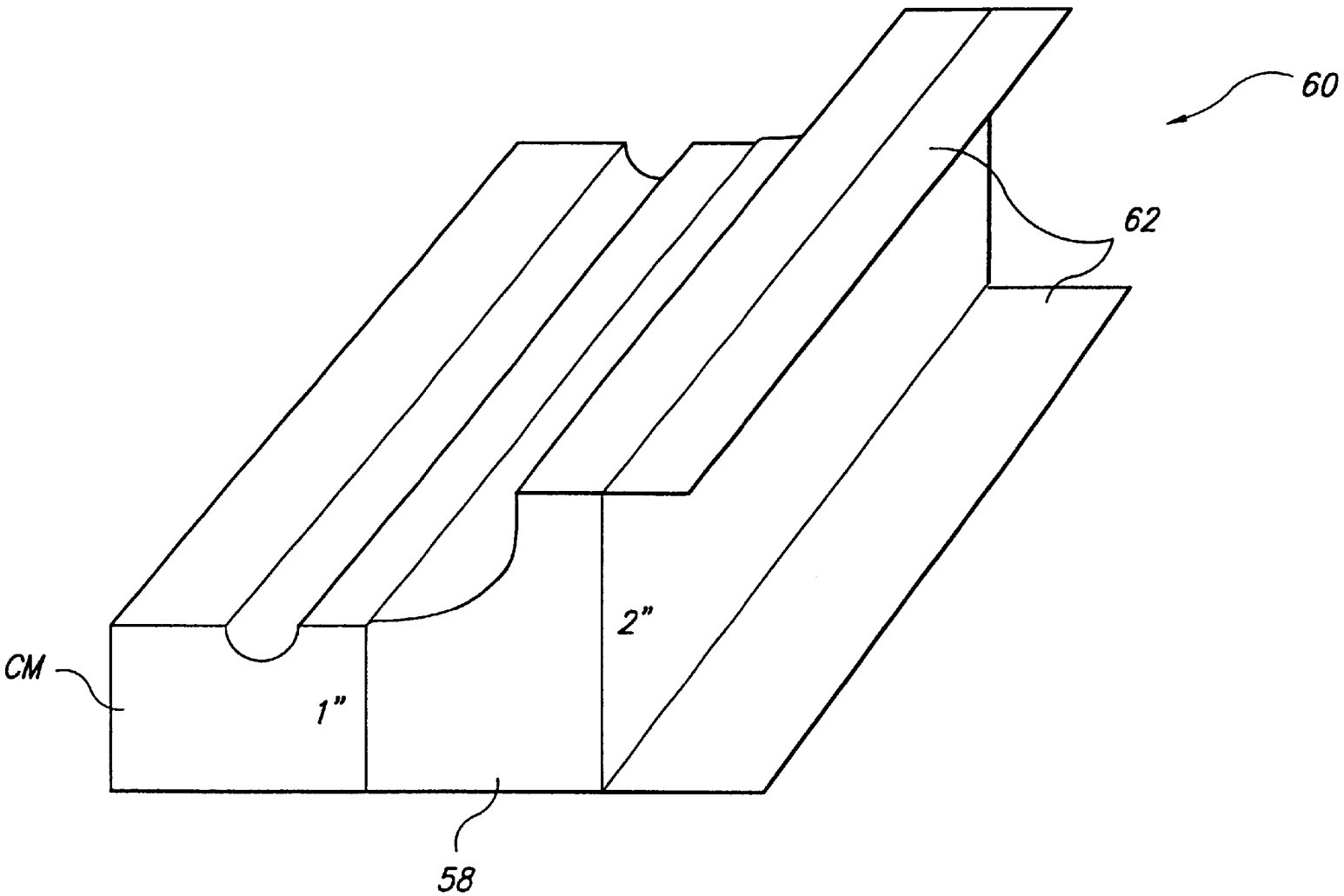
FIG. 8 is a perspective view of a window or door molding transition piece.

Moreover, referring to FIG. 8, because the siding panels 12 according to the invention are typically thicker than conventional siding (approximately two inches verses approximately one inch), a transition piece 58 between the siding and conventional exterior door and window molding CM can be provided to maintain a clean and continuous look. The transition piece 58 preferably includes a siding channel 60 defined by extension panels 62 for receiving the siding panels 12. The siding channel 60 is sized corresponding to a width of the siding (e.g., about two inches), and the transition piece 58 decoratively tapers to a width corresponding to the conventional moldings CM (e.g., about one inch).

By virtue of the structure according to the present invention, siding installation can be made easier thus reducing installation costs, and the resulting outer skin provides an efficient and effective exterior for a house or other structure.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An exterior wall covering panel attachable to supporting walls of a building structure, the exterior wall covering panel comprising:

a one-piece enclosure having an inner surface delimiting a single insulation chamber and an outer surface for attaching to supporting walls of a building structure, the one-piece enclosure requiring additional support structure;

an insulating material disposed in said single insulation chamber, wherein said one-piece enclosure defines a male engagement section and a female engagement section, said male engagement section defining an attachment member section and being shaped to engage a female engagement section of a first adjacent panel, and said female engagement section being shaped to receive a male engagement section of a second adjacent panel; and an attachment member cooperating with said attachment member section, said attachment member for securing the exterior wall covering panel to a supporting wall.

2. A wall covering panel according to claim 1, wherein said one-piece enclosure is formed of one of fiberglass, PVC, vinyl, ABS, aluminum and steel.

3. A wall covering panel according to claim 1, wherein said one-piece enclosure is formed of a plastic material.

4. A wall covering panel according to claim 1, wherein said insulating material is air.

5. A wall covering panel according to claim 1, wherein said insulating material is foam insulation.

6. A wall covering panel according to claim 1, wherein said male engagement section comprises a tab and wherein said female engagement section comprises a slot.

7. A wall covering panel according to claim 1, wherein said one-piece enclosure comprises an insulation aperture in the inner surface thereof, said insulating material being inserted into said insulation chamber via said insulation aperture.

8. A wall covering panel according to claim 1, wherein said one-piece enclosure is seamless.

9. A wall covering panel according to claim 1, wherein said attachment member extends through said female engagement section of a first adjacent panel.

10. A siding panel system attachable to a supporting wall surface of a building structure, the system comprising a plurality of external wall covering panels each including:

a one-piece enclosure having an inner surface delimiting a single insulation chamber and an outer surface for attaching to supporting walls of a building structure, the one-piece enclosure requiring additional support structure, wherein an insulating material is disposed in said single insulation chamber, and wherein said panels are interlockingly engageable in a stacked relationship via means for interlockingly engaging adjacent ones of said siding panels, the interlockingly engaging means defining an attachment member section; and an attachment member cooperating with said attachment member section, said attachment member for securing the exterior wall covering panel to a supporting wall.

11. A siding panel system according to claim 10, further comprising a corner kit that accommodates bends in the surface.

12. A siding panel system according to claim 11, wherein said corner kit comprises an angle frame that is bent corresponding to bends in a surface to which the angle frame is attachable, and at least one insert attachable to said angle frame in a vertical orientation, said angle frame including at least one connecting piece at an outside end thereof for attaching said panels.

13. A siding panel system according to claim 10, further comprising a transition piece sized at one end for receiving said panels and sized at another end substantially corresponding to conventional frame molding.

14. A siding panel system according to claim 10, wherein said attachment member extends through said female engagement section of a first adjacent panel.

15. An exterior wall covering panel attachable to supporting walls of a building structure, the exterior wall covering panel comprising:

a one-piece enclosure having an inner surface delimiting a single insulation chamber and an outer surface for attaching to supporting walls of a building structure, the one-piece enclosure being constructed to form part of a building structure outer shell without providing structural support;

an insulating material disposed in said single insulation chamber, wherein said one-piece enclosure defines a male engagement section and a female engagement section, said male engagement section defining an attachment member section and being shaped to engage a female engagement section of a first adjacent panel, and said female engagement section being shaped to receive a male engagement section of a second adjacent panel; and an attachment member cooperating with said attachment member section, said attachment member for securing the exterior wall covering panel to a supporting wall.

16. A wall covering panel according to claim 15, wherein said attachment member extends through said female engagement section of a first adjacent panel.

17. A siding panel system attached to a supporting wall surface of a building structure, the system comprising a plurality of external wall covering panels each including a one-piece enclosure having an inner surface delimiting a single insulation chamber and an outer surface attached to the supporting wall surface, wherein an insulating material is disposed in said single insulation chamber, and wherein said panels are interlockingly engageable in a stacked relationship.

* * * * *